US008356588B2

(12) United States Patent
Johnston et al.

(10) Patent No.: US 8,356,588 B2
(45) Date of Patent: Jan. 22, 2013

(54) SYSTEM AND METHOD FOR CONTROLLING COMBUSTION

(75) Inventors: David Fulton Johnston, Poquoson, VA (US); Michael McCall Mahler, Hayes, VA (US); David Michael Chapin, Kansas City, MO (US)

(73) Assignee: General Electric Company, Schenectady, NY (US)

( * ) Notice: Subject to any disclaimer, the term of this patent is extended or adjusted under 35 U.S.C. 154(b) by 535 days.

(21) Appl. No.: 12/697,104

(22) Filed: Jan. 29, 2010

(65) Prior Publication Data

US 2011/0186022 A1 Aug. 4, 2011

(51) Int. Cl.

| | |
|---|---|
| ***F02P 3/08*** | (2006.01) |
| *F02P 15/08* | (2006.01) |
| *F02D 43/00* | (2006.01) |
| *F02D 45/00* | (2006.01) |

(52) U.S. Cl. ... 123/597; 123/620; 123/605; 315/209 CD

(58) Field of Classification Search ..... 123/597, 123/594, 596, 598, 600, 605, 620; 315/209 CD, 315/209 M See application file for complete search history.

(56) References Cited

U.S. PATENT DOCUMENTS

| | | | | |
|---|---|---|---|---|
| 4,154,205 | A * | 5/1979 | Forster | 123/598 |
| 4,579,138 | A * | 4/1986 | Simoens | 137/102 |
| 6,584,965 | B1 * | 7/2003 | Ward | 123/605 |
| 6,948,484 | B2 * | 9/2005 | Umino et al. | 123/597 |
| 2009/0120336 | A1 | 5/2009 | Chapin et al. | |

FOREIGN PATENT DOCUMENTS

| | | | |
|---|---|---|---|
| GB | 2193758 | A | 2/1988 |
| JP | 57035221 | A | 2/1982 |
| JP | 10220757 | A | 8/1998 |

OTHER PUBLICATIONS

Search Report from corresponding GB Application No. GB1100833.1 dated May 19, 2011.

* cited by examiner

*Primary Examiner* — Hieu T Vo

(74) *Attorney, Agent, or Firm* — Fletcher Yoder, P.C.

(57) ABSTRACT

A system, in one embodiment, includes a combustion-based system having a combustion chamber. The system also includes an ignition control system. The ignition control system includes an ignition device coupled to the combustion chamber, control circuitry having an energy storage device configured to supply energy to the ignition device to produce an ignition event having a desired energy level, and a controller configured to obtain a target voltage across the energy storage device and to discharge an ignition energy from the energy storage device after obtaining the target voltage, wherein the ignition control system is configured to supply the ignition energy to the ignition device to produce the ignition event.

20 Claims, 6 Drawing Sheets

SYSTEM AND METHOD FOR CONTROLLING COMBUSTION

BACKGROUND OF THE INVENTION

The subject matter disclosed herein relates generally to combustion systems and, more particularly, to systems and methods for controlling ignition sources utilized in such combustion systems.

Combustion-based systems, such as impulse cleaning systems, use the pressure of the hot combustion gases or resulting supersonic shock waves directed toward a surface to remove built-up deposits and/or debris from the surface.

It may be challenging to control certain aspects (e.g., energy output, frequency, etc.) of ignition events (e.g., an electrical spark) produced by an ignition source to achieve desired target combustion characteristics for a particular application. Accordingly, there exists a need for a technique for improving the control of ignition events associated with such combustion-based systems.

BRIEF DESCRIPTION OF THE INVENTION

In one embodiment, a system includes a combustion-based system having a combustion chamber. The system also includes an ignition control system. The ignition control system includes an ignition device coupled to the combustion chamber, control circuitry having an energy storage device configured to supply energy to the ignition device to produce an ignition event having a desired energy level, and a controller configured to obtain a target voltage across the energy storage device and to discharge an ignition energy from the energy storage device after obtaining the target voltage, wherein the ignition control system is configured to supply the ignition energy to the ignition device to produce the ignition event.

In a further embodiment, a tangible machine-readable storage media having encoded instructions executable by a processor includes code configured to initiate charging of a capacitor of an ignition control circuit, wherein the ignition control circuit is configured to supply energy to an ignition device to produce a first ignition event having a desired energy level for igniting a mixture of fuel and oxidizer within a combustion chamber of a combustion-based system. The tangible machine-readable storage media also includes code configured to identify a full charge state of the capacitor. Further, the tangible machine-readable storage media includes code configured to, after identification of the full charge state of the capacitor, discharge a first portion of energy stored in the capacitor to a resistive device until a voltage across the capacitor corresponds to a target voltage. Finally, the tangible machine-readable storage media includes code configured to, when the voltage across the capacitor corresponds to the target voltage, discharge a remaining portion of energy from the capacitor to the ignition device to produce the first ignition event.

In yet another embodiment, an impulse cleaning system includes a combustion chamber configured to receive a mixture of fuel and air, wherein the mixture of fuel and air is ignitable to produce combustion that results in a shock wave. The impulse cleaning system includes an ignition control system configured to produce an electrical spark having a desired energy level for igniting the mixture of air and fuel. The ignition control system includes a spark plug configured to produce an electrical spark within the combustion chamber for igniting the mixture of fuel and air. The ignition control system also includes control circuitry comprising a capacitor configured to supply energy to the spark plug to produce the electrical spark. Further, the ignition control system includes a controller configured to charge the capacitor to a full charge state, to discharge a first portion of energy from the full charge state of the capacitor to a resistive device until a voltage measured across the capacitor corresponds to a target voltage, and, when the voltage measured across the capacitor corresponds to the target voltage, to discharge a remaining portion of energy from the capacitor to the spark plug to produce the electrical spark having the desired energy level to ignite the mixture of fuel and air and to produce the shock wave.

BRIEF DESCRIPTION OF THE DRAWINGS

These and other features, aspects, and advantages of the present invention will become better understood when the following detailed description is read with reference to the accompanying drawings in which like characters represent like parts throughout the drawings, wherein.

DETAILED DESCRIPTION OF THE INVENTION

Figure 1:
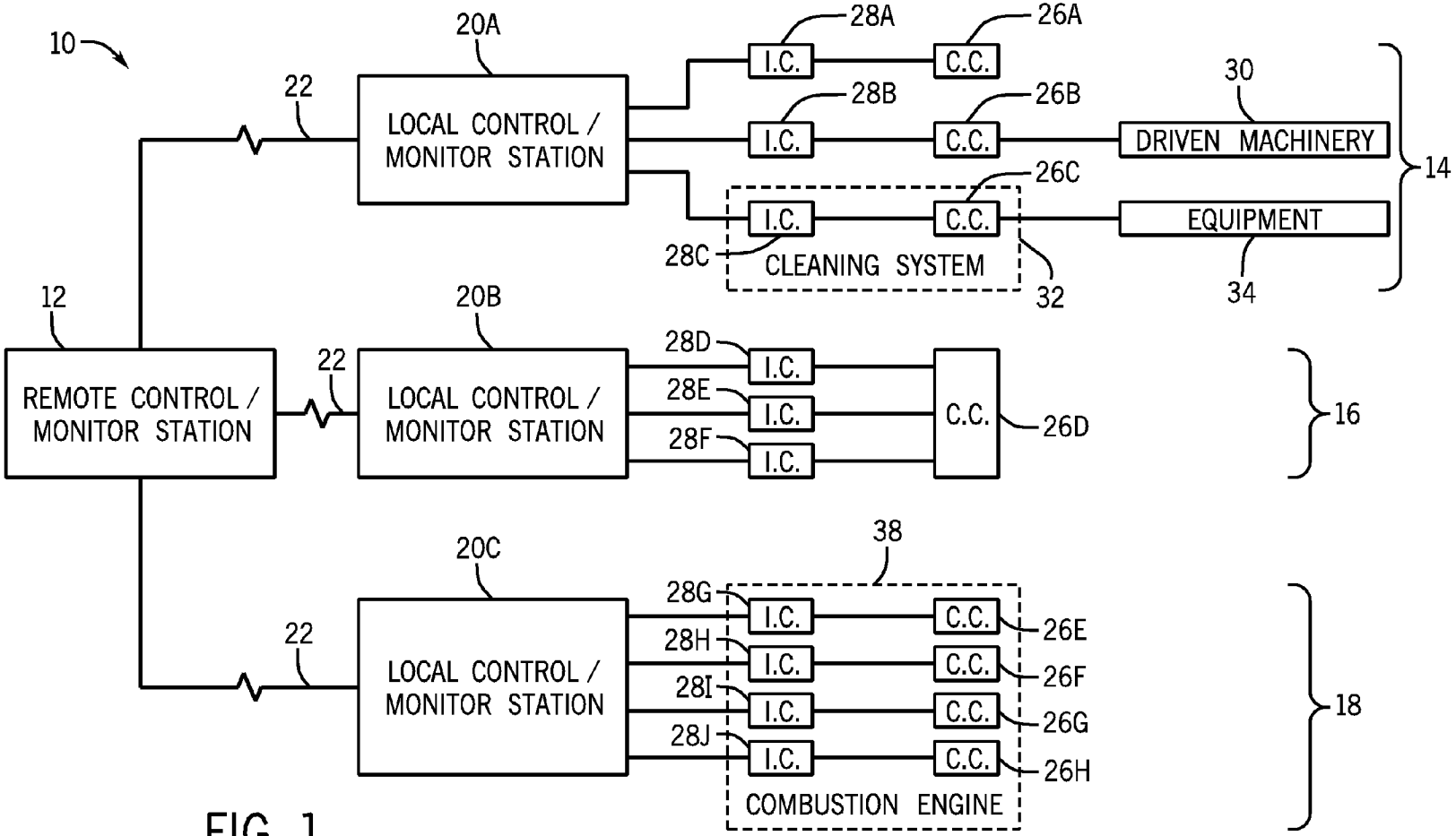
FIG. 1 is a simplified block diagram depicting an embodiment of a networked system that includes multiple combustion-based systems, each being controlled by at least one ignition control system.

One or more specific embodiments of the present invention will be described below. In an effort to provide a concise description of these embodiments, all features of appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments of the present invention, the articles "a," "an," "the," and "said" are intended to mean that there are one or more of the elements. The terms "comprising," "including," and "having" are intended to be inclusive and mean that there may be additional elements other than the listed elements.

As discussed further below, certain embodiments provide an ignition control system configured generate and deliver electrical energy to an ignition device or ignition source, thus producing an ignition event to initiate combustion in a combustion-based system. By way of example, in one embodiment, the ignition control system may include logic or circuitry configured to generate an electrical spark at a spark plug. The electrical spark may facilitate combustion by igniting a mixture of fuel (e.g., liquid or gas fuel) and an oxidizer (e.g., such as air) within a combustion chamber of the combustion-based system. In other embodiments, the ignition device or source may be a laser pulse, plasma igniter, or some other heat source suitable for igniting a combustible mixture of fuel and air.

In certain embodiments, the ignition control system may be configured to accurately control the energy released by such ignition events, as well as the speed and/or frequency at which the ignition events occur. By way of example, in the above-mentioned embodiment that produces electrical sparks, the ignition control system may be configured to generate a single electrical spark having a desired energy content and/or multiple electrical sparks at a high repetition rate (e.g., frequency), each spark having a desired energy content. Depending on the needs of a particular combustion application, the ignition control system may be configured to vary the energy content of the electrical sparks (e.g., ignition event) and/or the frequency at which the electrical sparks occur. For example, the ignition control system may generate a series of several ignition events, each having the same or different energy levels, in rapid succession as a "burst," before pausing and subsequently generating another burst of ignition events.

In some embodiments, a combustion chamber may include multiple ignition sources, each of which is controlled by a respective ignition control system. For instance, the ignition control systems may control the generation of ignition events from the various ignition sources in an anti-coincident manner, such that none of the ignition sources produce ignition events simultaneously. In further embodiments, the ignition control system may also include the functionality to control other aspects of combustion, such as the air-fuel ratio, by controlling the flow rate of air and/or fuel supplied to the combustion chamber. As will be discussed further below, the various techniques summarized above may be utilized in various types of combustion-based systems, such as heaters, boilers, gas-turbine systems, impulse cleaning systems, combustion engines, and so forth.

With the foregoing in mind, FIG. 1 provides a block diagram that illustrates a networked combustion-based system 10. The system 10 may include a remote control monitoring station 12 and various combustion-based subsystems 14, 16, and 18. As shown, each of the combustion-based subsystems 14, 16, and 18 may be controlled by respective local control/monitoring stations 20A, 20B, and 20C. As will be discussed further below, a user (or respective users) may operate each of the local control/monitoring stations 20A, 20B, and 20C to set or define desired ignition characteristics, such as frequency and energy output, for each ignition source within a particular combustion-based subsystem 14, 16, or 20. Further, each of the local control/monitoring stations 20A, 20B, and 20C may be communicatively coupled to the remote control/monitoring station 12 via the communication lines 22. The communication lines 22 may represent a wired network, such as an Ethernet-based local area network (LAN), a wireless network (e.g., 802.11 standard), a virtual private network (VPN), an Internet connection, or a wide area network (e.g., such as an EDGE or 3G mobile network) and so forth. Thus, by way of the communication lines 22, the local control/monitoring stations 20A, 20B, and 20C and, therefore, their respective combustion-based subsystems 14, 16, and 18, may be controlled remotely from the remote control/monitoring station 12. While only a single remote control/monitoring station 12 is depicted in FIG. 1, it should be appreciated that some embodiments of the system 10 may include multiple remote control/monitoring stations 12 disposed at various locations remote from the combustion-based subsystems 14, 16, and 18.

Before continuing, it should be understood that the system 10 shown in FIG. 1 is intended to illustrate several different combustion-based applications in which the presently described techniques may be applied. Each illustrated combustion-based application may include a combustion chamber 26 having an ignition source or device, and an ignition control system 28 that controls the operation of the ignition source in order to produce ignition events having certain desired properties. These ignition properties may include a target energy level or a frequency rate (e.g., for multiple ignition events that occur in succession), as well as the intensity, amplitude, and timing factors that relate to combustion dynamics. Thus, FIG. 1 is intended to provide a brief overview regarding the types of applications that may utilize the presently disclosed ignition control techniques. However, it should be understood that the present techniques may be applied to any suitable combustion-based application, and is not intended to be limited to the particular examples described herein. Following this brief overview, specific embodiments of the ignition control system 28 and its functionality will be discussed in more detail with respect to FIGS. 2-5.

As shown in FIG. 1, the subsystem 14 may include the combustion chambers 26A, 26B, and 26C. Each of the combustion chambers 26A, 26B, and 26C may receive a supply of air and fuel, which are mixed in an appropriate proportion, and then ignited by an ignition source. For instance, in some embodiments, the ignition source may be a spark plug configured to provide an electrical spark for igniting the air-fuel mixture. In other embodiments, the ignition source may include a laser pulse, plasma igniter, or some other heat source suitable for igniting a combustible mixture of fuel and air. In the depicted embodiment, the ignition control system 28A may control the ignition source of the combustion chamber 26A. For example, the combustion chamber 26A may be part of a boiler system which is configured to utilize the resulting heat from combustion to heat a liquid (e.g., water).

The ignition control system 28B may control the ignition source of the combustion chamber 26B, which may be part of a combustion-based system that drives machinery 30. For example, the combustion chamber 26B may be part of a gas turbine engine system, in which exhaust gases produced by the combustion process may be utilized to drive the blades of a turbine to produce rotational energy. The rotational energy of the turbine may in turn drive a load, such as an electrical generator in a power plant, a propeller on an aircraft, vehicle, boat, and so forth. Additionally, the rotational energy of the turbine may also drive a compressor of the turbine system. Thus, it should be understood that the driven machinery 30 may include a turbine, a compressor, a load, and various other components.

Further, the ignition control system 28C may control the ignition source of the combustion chamber 26C, which may form the components of an impulse cleaning system 32. As will be discussed below in FIG. 6, an impulse cleaning system 32 may utilize shock waves produced by the combustion process within the combustion chamber 26C to clean a surface of a unit of equipment 34. By way of example, the surface may be the wall of a boiler vessel that is contaminated with soot, debris, or other buildup resulting from its own combustion processes (e.g., combustion within the boiler system itself). For example, the contaminated surface may lower system efficiency by reducing the amount of heat that is transferred to a fluid. Thus, the combustion shock waves produced by the impulse cleaning system 32 may be directed at the contaminated surface to loosen debris, deposits, and coatings that have accumulated on the contaminated surface of the equipment 34.

While the combustion chambers 26A, 26B, and 26C of the subsystem 14 are each depicted as including a single ignition source controlled by the respective ignition control systems 28A, 28B, and 28C, certain embodiments of each combustion chamber may include multiple ignition sources. For example, as shown in subsystem 16, the combustion chamber 26D may include three separate ignition sources, each controlled by a respective ignition control system 28D, 28E, and 28F. Thus, each of the ignition control systems 28D, 28E, and 28F may be configured to produce ignition events for igniting an air-fuel mixture within the combustion chamber 26D, thus producing hot combustion gases. In such an embodiment, the local control/monitoring station 20B, in addition to defining target energy levels and/or frequency rates at which ignition events occur, may further control each of the ignition control systems 28D, 28E, and 28F to control the timing of their respective ignition events (e.g., electrical sparks). For instance, the ignition control systems 28D, 28E, and 28F may be configured such that their respective ignition events occur simultaneously within the combustion chamber 26D, or in an anti-coincident manner, such that none of the ignition events associated with each of the ignition control systems 28D, 28E, and 28F occur concurrently. Thus, the local control/monitoring station 20B (as well as 20A and 20C) may allow an operator to monitor or change the characteristics of ignition events by adjusting one or more of the above-mentioned parameters.

Referring further to the subsystem 18, a combustion engine 38 is depicted and includes the ignition control systems 28G, 28H, 28I, and 28J, which control the combustion chambers 26E, 26F, 26G, and 26H, respectively. By way of example, the engine 38 may be a four-cylinder (each of the chambers 26E, 26F, 26G, and 26H representing one cylinder) internal combustion engine for a vehicle, such as an automobile. Thus, the ignition control systems 28G, 28H, 28I, and 28J may control combustion within the combustion chambers 26E, 26F, 26G, and 26H, respectively, of the internal combustion engine 38. In the depicted embodiment, the local control/monitoring station 20C may be part of an engine control unit (ECU) for a vehicle. While the local control/monitoring station 20C is depicted as being coupled to the network 22 for illustrative purposes, it should be appreciated that an actual implementation of the engine 38 in a vehicle may not necessarily be coupled to the remote control/monitoring station 12 to provide for remote control.

Figure 2:
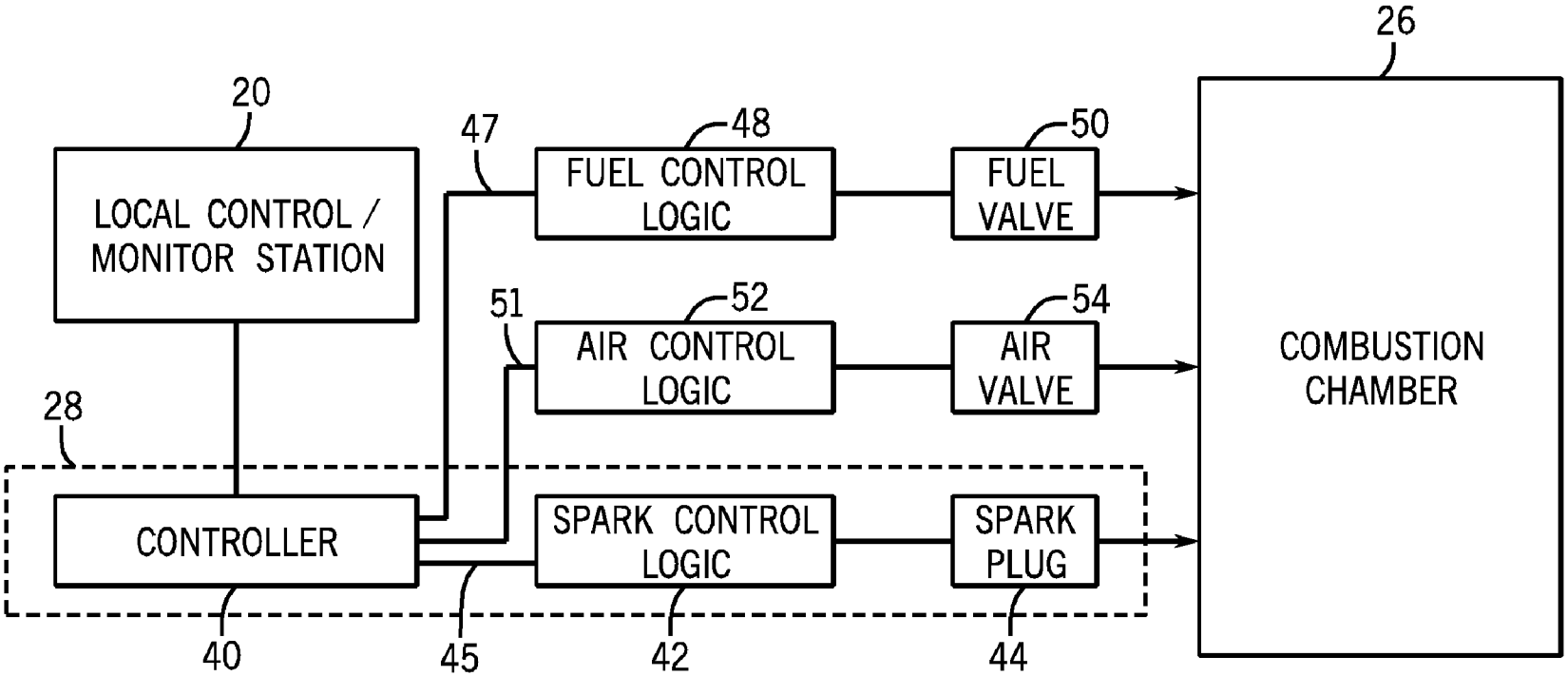
FIG. 2 is a block diagram depicting an embodiment of an ignition control system that may be utilized for controlling combustion in one of the combustion-based systems of FIG. 1.

FIG. 2 is a simplified block diagram that depicts an embodiment of the ignition control system 28 that is configured to produce an ignition event in the form of an electrical spark, using a spark plug 44 as an ignition device. As discussed above, however, other embodiments of the ignition control system 28 may utilize other types of ignition devices, such as laser pulsing devices, plasma igniting devices, or some other suitable type of heat source suitable for igniting a mixture of combustible fuel and air.

The illustrated ignition control system 28 includes a controller 40, spark control logic 42, and the spark plug 44. The controller 40 may include a variety of hardware to execute logic, such as the spark control logic 42. For example, the controller 40 may include a processor, a microcontroller, a programmable logic controller, an application specific integrated circuit, or other programmable circuits, or any combination thereof. The controller 40 may include one or more tangible machine readable storage media, such as read-only memory (ROM), random access memory (RAM), solid state memory (e.g., flash memory) or a combination thereof. The storage media may store encoded instructions, such as firmware, that may be executed by the controller 40 to operate the spark control logic 42. For instance, the spark control logic 42 may include one or more circuit components configured to deliver energy to the spark plug 44 in order to generate an electrical spark having a desired energy level for igniting an air-fuel mixture to produce hot combustion gases within the combustion chamber 26.

During operation, various signals 45 may be exchanged between the controller 40 and the spark control logic 42. For instance, as will be discussed in further detail with respect to FIG. 3, the signals 45 may include signals that control the charging of energy storage elements, such as one or more capacitors, within the spark control logic 42, and may also represent sensed feedback data, such as measurements pertaining to capacitor voltage and/or charge. As will be appreciated, by controlling the charging and discharging of the energy storage element(s) (e.g., capacitor(s)) of the spark control logic 42 based upon desired parameters, the ignition control system 28 may provide an ignition event (e.g., an electrical spark via the spark plug 44) or a series of multiple ignition events having a desired energy level and/or frequency for achieving desired combustion characteristics within the combustion chamber 26. The operation of the spark control logic 42 will be described in more detail below with respect to FIGS. 3-5. Further, while the controller 40 is depicted in FIG. 2 as operating a single spark control circuit 42, it should be appreciated that in certain embodiments, the controller 40 may operate multiple spark control circuits 42. For instance, with regard to the subsystem 16 of FIG. 1, the ignition control systems 28D, 28E, and 28F may share a common controller 40, such that a single common controller 40 is configured to operate each of the spark control circuits 42 associated with each of the ignition control systems 28D, 28E, and 28F. Similarly, with regard to the subsystem 18, a single controller 40 may be configured to operate each of the spark control circuits 42 associated with each of the ignition control systems 28G, 28H, 28I, and 28J of the combustion engine 38.

The parameters for achieving the desired energy output of the ignition events, the frequency at which the ignition events occur, the timing of when an ignition event starts, and/or the desired combustion characteristics may be set and modified by an operator using the local control/monitoring station 20. For instance, in some embodiments, the local control/monitoring station 20 may include a user interface, such as a graphical user interface (GUI), to enable an operator to enter and/or modify such parameters. Thus, an operator may monitor and adjust ignition characteristics locally via the local control/monitoring station 20, or remotely using the remote control/monitoring station 12. Additionally, the local control/monitoring station 20 and/or the remote control/monitoring station 12 may include functions to display data indicative of energy levels during ignition events in a graphical (e.g., visual) manner. Further, in some embodiments, operation feedback data or user initiated inputs may be utilized by any of the subsystems 14, 16, and 18 to adjust and/or modify combustion parameters (e.g., energy, frequency, timing, pressures, etc.) during operation. For instance, the subsystems 14, 16, and 18 may be configured to adjust such parameters on the fly or in substantially real-time in response to feedback and/or user inputs.

As further shown in FIG. 2, the controller 40 of the ignition control system 28 may also be configured to communicate with fuel control logic 48 by way of the signal(s) 47 and with the air control logic 52 by way of the signal(s) 51. In response to the controller 40, the fuel control logic 48 may be configured to control or manipulate a fuel valve 50 to control or adjust the flow rate of fuel supplied to the combustion chamber 26. Similarly, the air control logic 52 may, in response to the controller 40, control or manipulate an air valve 54 to adjust the flow rate of air supplied to the combustion chamber 26. Though not depicted in FIG. 2, in one embodiment, a fuel safety valve may be provided in series with the fuel valve 50. Thus, in the event that the fuel valve 50 malfunctions and is unable to stop or control the flow or fuel, the fuel safety valve may be operated either manually or by the controller 40 as a safety measure to stop an unwanted flow of fuel.

In certain embodiments, the controller 40 may include analog or digital outputs for controlling the fuel valve 50 and the air valve 54. For instance, the controller 40 may control the position of the valves 50 or 54, such as by toggling the state of the valves 50 or 54 between a fully-open position, a full-closed position, and an intermediate position (e.g., partially opened or closed), to control the flow rate of air or fuel. Additionally, the controller 40 may also utilize the analog or digital outputs for controlling valve timing characteristics, such as by controlling a period of time over which a valve (e.g., 50 or 54) is open or closed in relation to other events within the combustion-based system. By way of example only, the sequence in which the fuel valve 54 is turned on or off may be determined in relation to when the air valve 50 is turned on or off, when the ignition event (e.g., an electrical spark) occurs, and so forth. As can be appreciated, these parameters may be set or modified using the local control/monitoring station 20 and/or by remote control/monitoring station 12 that is networked with the local control/monitoring station 20, as discussed above.

Thus, in addition to controlling the energy output of the spark plug 44, the adjustment of air and fuel flow rates may allow for the air-fuel ratio within the combustion chamber 26 to be controlled and/or maintained at a particular level to achieve desired combustion characteristics. Further, while the functionality for adjusting air and fuel flow is shown in FIG. 2 as being integrated within the controller 40, it should be understood that in other embodiments, such functionalities may be provided by separate controllers in communication with the local control/monitoring station 20 (e.g., separate respective controllers may control the fuel control logic 48 and the air control logic 52).

Figure 3:
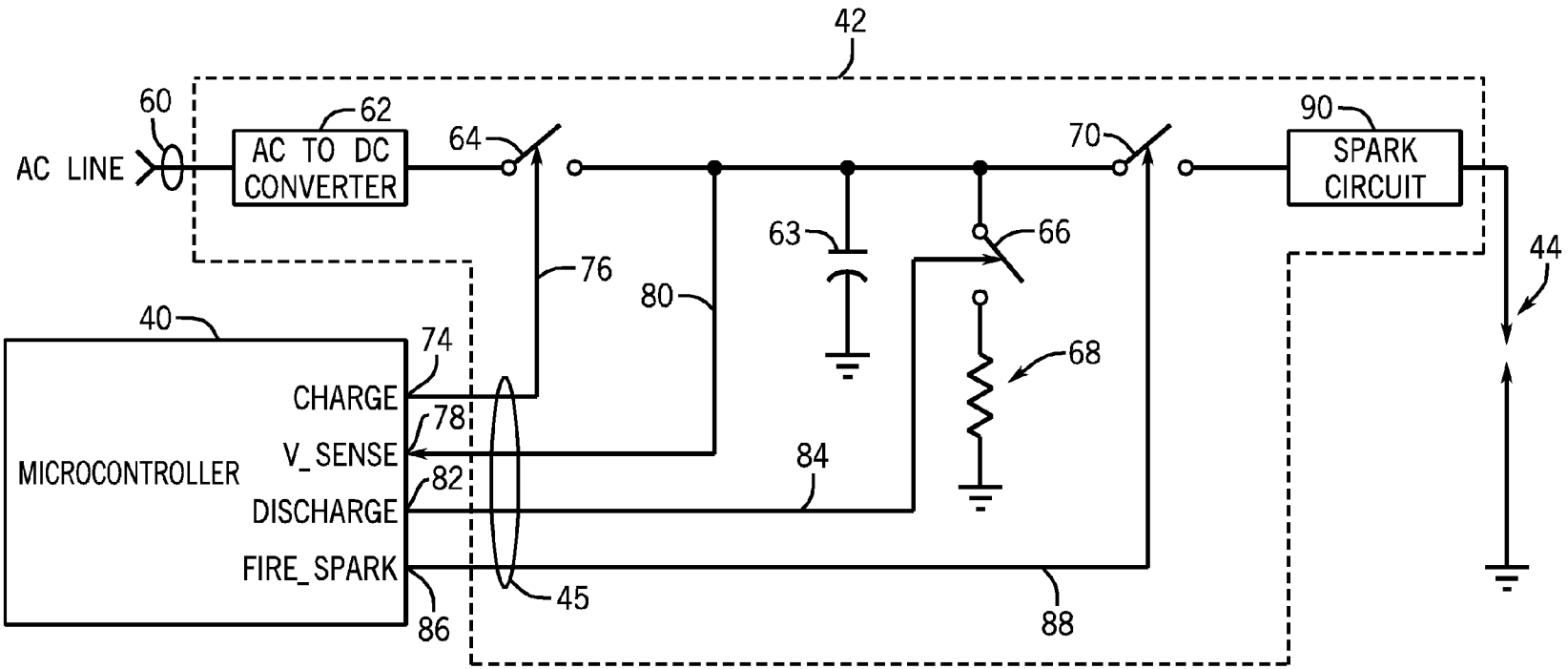
FIG. 3 is a circuit schematic diagram showing an embodiment of the ignition control system of FIG. 2.

FIG. 3 is a circuit schematic diagram that depicts one embodiment of the spark control logic 42, as shown in FIG. 2. As shown the spark control logic 42 may be powered by a power line 60 that provides AC power, which may be single phase or three phase. The power line 60 may provide a high-energy low-impedance charging source for charging an energy storage device, such as a storage capacitor 63. For instance, the power line 60 may represent a connection to a generator or an AC power grid. An AC to DC converter 62 converts an AC signal to a DC signal, which may then be utilized for charging the capacitor 63. As will be appreciated, the AC to DC converter 62 may include one or more rectifiers, or any other suitable components capable of converting an AC signal to a DC signal.

The spark control logic 42 includes a charge switch 64, a discharge switch 66, a discharge resistor 68, and an ignition switch 70. The controller 40, which is depicted in the present embodiment as a microcontroller, includes a first input/output (I/O) port 74 that outputs a control signal 76 for toggling the charge switch 64 between an open and closed state, a second I/O port 78 that receives a signal 80 indicative of the voltage across the capacitor 63, a third I/O port 82 that outputs a control signal 84 for toggling the discharge switch 66 between an open and closed state, and a fourth I/O port 86 that outputs a control signal 88 for toggling the ignition switch 70 between an open and closed state. The signals 76, 80, 84, and 88 may form the various signals 45 discussed in FIG. 2. Further, as discussed above, the controller 40 may be configured to control multiple spark control circuits 42. In such embodiments, the controller 40 may be provided with respective sets of I/O ports (e.g., ports 74, 78, 82, and 86) for each spark control circuit 42 it is configured to control.

As will be discussed in more detail below with respect to FIGS. 4 and 5, the spark control logic 42, under control of the microcontroller 40, may generate an electrical spark across the spark plug 44 by obtaining a desired voltage at the storage capacitor 63 and then releasing the energy stored in the capacitor 63 once the desired voltage is obtained. In one embodiment, the spark control logic 42 and the microcontroller 40 may be configured to utilize a discharge control algorithm, in which the capacitor 63 is fully charged and subsequently discharged at a controlled rate to obtain a voltage level for producing an electrical spark having a desired energy level, which may be expressed by the following equation:

$$E = \frac{1}{2} C V_C^2, \qquad \text{(Equation 1)}$$

wherein E represents the desired energy output in joules, C represents the capacitance value of the capacitor 63, and $V_C$ represents the voltage across the capacitor 63. In one embodiment, the capacitor 63 may have a capacitance of between approximately 1 to 50 μF or, more specifically, between approximately 3 to 20 μF or, even more specifically, between approximately 4.7 to 9.4 μf. Further, while the spark control circuitry 42 is depicted herein as having a single capacitor 63, some embodiments of the spark control circuitry 42 may include multiple capacitors 63. For instance, multiple capacitors 63 (e.g., 2, 3, 4, 5, or more) may be arranged in a parallel configuration to provide the total desired capacitance.

As discussed above, in one embodiment, the spark control circuitry 42 may operate based upon a discharge control algorithm, in which a target or desired voltage ($V_C$) across the capacitor 63 for producing the desired energy output (E) (e.g., in accordance with Equation 1) is obtained by first fully charging the capacitor 63 (e.g., bulk charging) and then discharging the capacitor 63 at a controlled rate until the target voltage $V_C$ is obtained. In such an embodiment, all of the switches 64, 66, and 70 may initially be open, and the capacitor 63 may be fully discharged (e.g., storing no charge or a negligible amount of charge). The microcontroller 40 may first send a control signal 76 to close the charge switch 64, thereby allowing the DC signal from the AC to DC converter 62 to provide charge to the capacitor 63. During this charging phase, the microcontroller 40 may sense (via I/O port 78) the voltage across the capacitor 63 via the feedback signal 80 to determine when the capacitor 63 is fully charged.

Once the capacitor 63 is fully charged, the microcontroller 40 causes the charge switch 64 to transition to an open state (via signal 76) and causes the discharge switch 66 to close (via signal 84). This causes the capacitor 63 to begin releasing some of its stored charge to the resistor 68. By way of example only, in one embodiment, the resistor 68 may include one or more resistors having a resistance of between approximately 3 to 20 kilo-ohms (Kohms) or, more specifically, between approximately 4.7 to 9.4 Kohms. During this discharge phase, the microcontroller 40 continues to sense the voltage across the capacitor 63. When the microcontroller 40 detects the target voltage $V_c$ across the capacitor 63 for obtaining the desired energy output E, the microcontroller 40 opens the discharge switch 66, thereby stopping the release of stored energy into the resister 68. Subsequently, the microcontroller 40 closes the ignition switch 70 via the control signal 88. This causes the remaining charge stored in the capacitor 63 to be discharged to the spark circuit 90, which may include one or more inductive elements for producing the electrical spark at the spark plug 44. Based upon Equation 1, the remaining charge stored in the capacitor 63 when the ignition switch 70 is closed produces an ignition event having the desired target energy output E.

Figure 4:
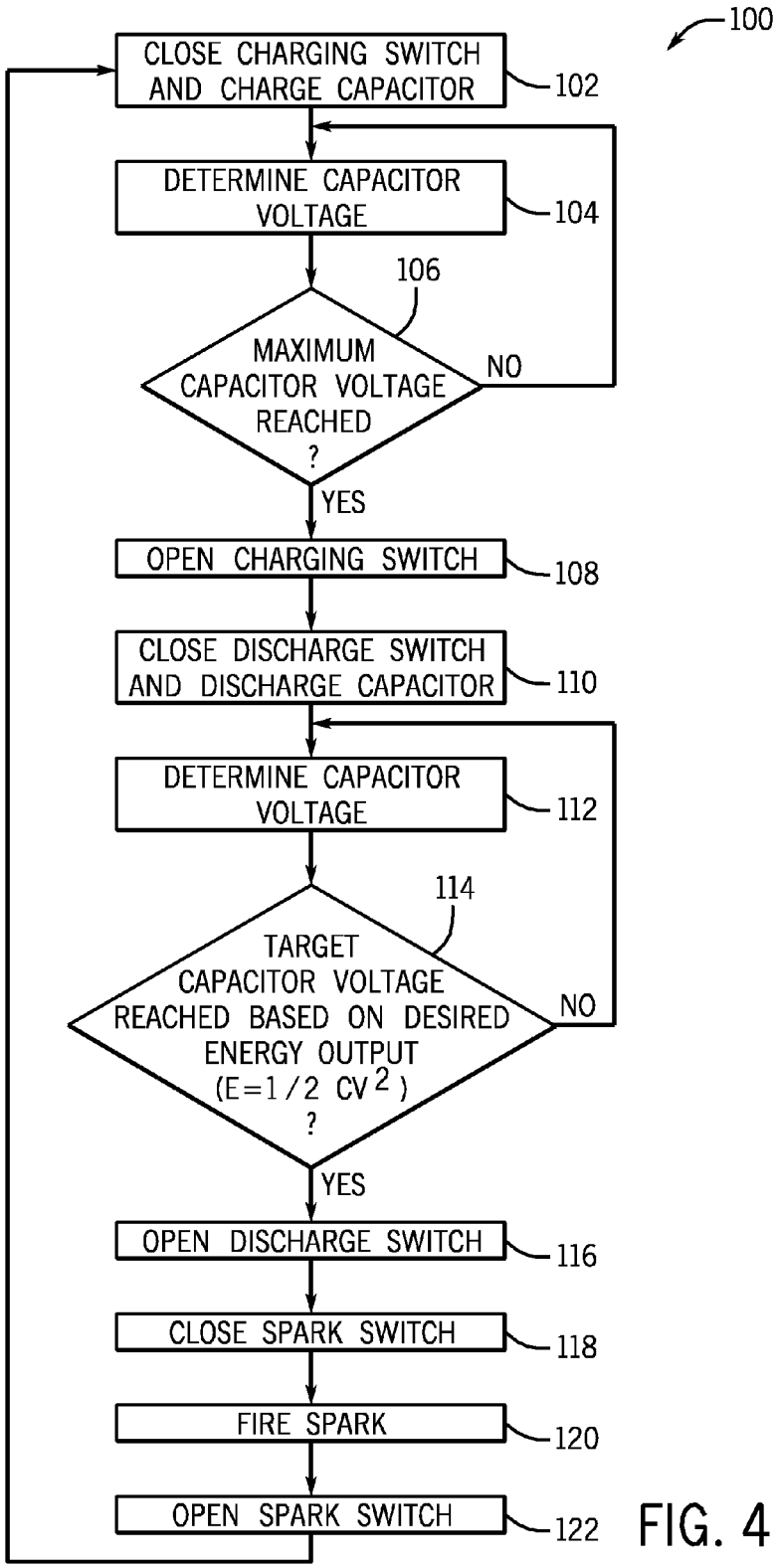
FIG. 4 is a flow chart illustrating a method for operating the ignition control system shown in FIG. 3, in accordance with one embodiment.

Referring to FIG. 4, the discharge control algorithm discussed in FIG. 3 is further illustrated by way of a flowchart depicting a method 100. As discussed above, the capacitor 63 may initially be discharged, and the switches 64, 66, and 70 may initially be in opened states. At step 102, the charging switch 64 is closed and the capacitor 63 may be charged using the power provided by the power line 60. During the charging phase, the microcontroller 40 may continuously or intermittently monitor the voltage across the capacitor 63, as depicted at step 104. At decision step 106, a determination is made as to whether the capacitor 63 has been fully charged (e.g., that a maximum voltage has been reached). As will be appreciated, the maximum voltage value(s) may be stored in the microcontroller 40 or, alternatively, the microcontroller 40 may determine that a maximum voltage is reached once the increase (e.g., rate of change with respect to time) of capacitor voltage has approached an asymptote. If, at step 106, the capacitor 63 has not been fully charged, then the method 100 returns to step 104 and charging continues.

If the capacitor 63 is fully charged at step 106, the method 100 continues to step 108, wherein the charge switch 64 is opened. Next, at step 110, the discharge switch 66 is closed and the capacitor 63 begins to discharge through the discharge resistor 68. During the discharge phase, the microcontroller 40 may continuously or intermittently monitor the voltage across the capacitor 63, as depicted at step 112. At decision step 114, a determination is made as to whether the voltage across the capacitor 63 matches the target voltage ($V_c$) corresponding to the desired energy output (E). That is, the microcontroller 40 may accurately predict the energy level of an ignition event (e.g., an electrical spark) based, for instance, upon Equation 1, as discussed above. If, at step 114, the capacitor 63 has not been discharged to the level corresponding to the target voltage ($V_C$), then the method 100 returns to the step 112, wherein the discharge switch 66 remains closed and the capacitor 63 continues to discharge under the control of the microcontroller 40.

If, at step 114, it is determined that the voltage across the capacitor 63 matches the target voltage ($V_C$), the discharge switch 66 is opened at step 116. Next, the ignition switch 70 is closed at step 118. As discussed above, this causes the remaining charge stored in the capacitor 63 to be discharged to the spark circuit 90, which causes an electrical spark having the desired energy level (E) to be produced at the spark plug 44 at step 120. Thereafter, the ignition switch 70 is opened at step 122. As shown in FIG. 4, the step 122 may return to step 102, whereby the method 100 repeats thereafter.

As will be appreciated, the microcontroller 40 and the spark control circuitry 42 may be configured to accurately control the energy of the electrical spark, as well as the frequency at which multiple electrical sparks occur with respect to one another. For instance, the microcontroller 40 may cause a single high-energy electrical spark to be produced. The energy level (E) of the electrical spark may be varied or adjusted by the microcontroller 40 as needed (e.g., in response to firmware programming or inputs/settings received via the local control/monitoring station 20 or remote control/monitoring station 12). Thus, electrical sparks having identical or varying energy characteristics may be repeatedly generated at a particular frequency by the microcontroller 40 and the spark control circuitry 42 in accordance with the present technique.

For instance, a series of electrical sparks, referred to as a burst, may occur in succession within a short amount of time. By way of example only, in some embodiments, the frequency at which electrical sparks are repeated may be between 1 to 100 Hz (e.g., 1, 10, 20, 30, 40, 50, 60, 70, 80, 90, or 100 Hz) or, more specifically, between approximately 1 to 60 Hz. A series of electrical sparks (e.g., a burst) produced by the microcontroller 40 and the spark control circuitry 42 may each have different or equal energy characteristics. Further, successive bursts of electrical sparks may also vary in repetition rates and/or frequencies. As will be appreciated, these techniques allow for a high degree of precision in controlling the energy level released by the electrical spark, as well as the frequency at which such electrical sparks (or other suitable types of ignition events) are produced.

In one embodiment, the desired energy output may vary depending on the combustion-based application in which the ignition event is being applied. For instance, in an impulse cleaning system, the desired energy level of an electrical spark generated by the above-described spark control circuit 42 may be up to approximately 1 joule (J) or more. By way of example only, the desired energy level of an electrical spark for an impulse cleaning system (e.g., 32) may be between approximately 0.5 J to 1 J. For comparison, the energy level of an electrical spark generated in a spark plug for an internal combustion engine in an automobile may be between approximately 15 to 20 mJ.

Figure 5:
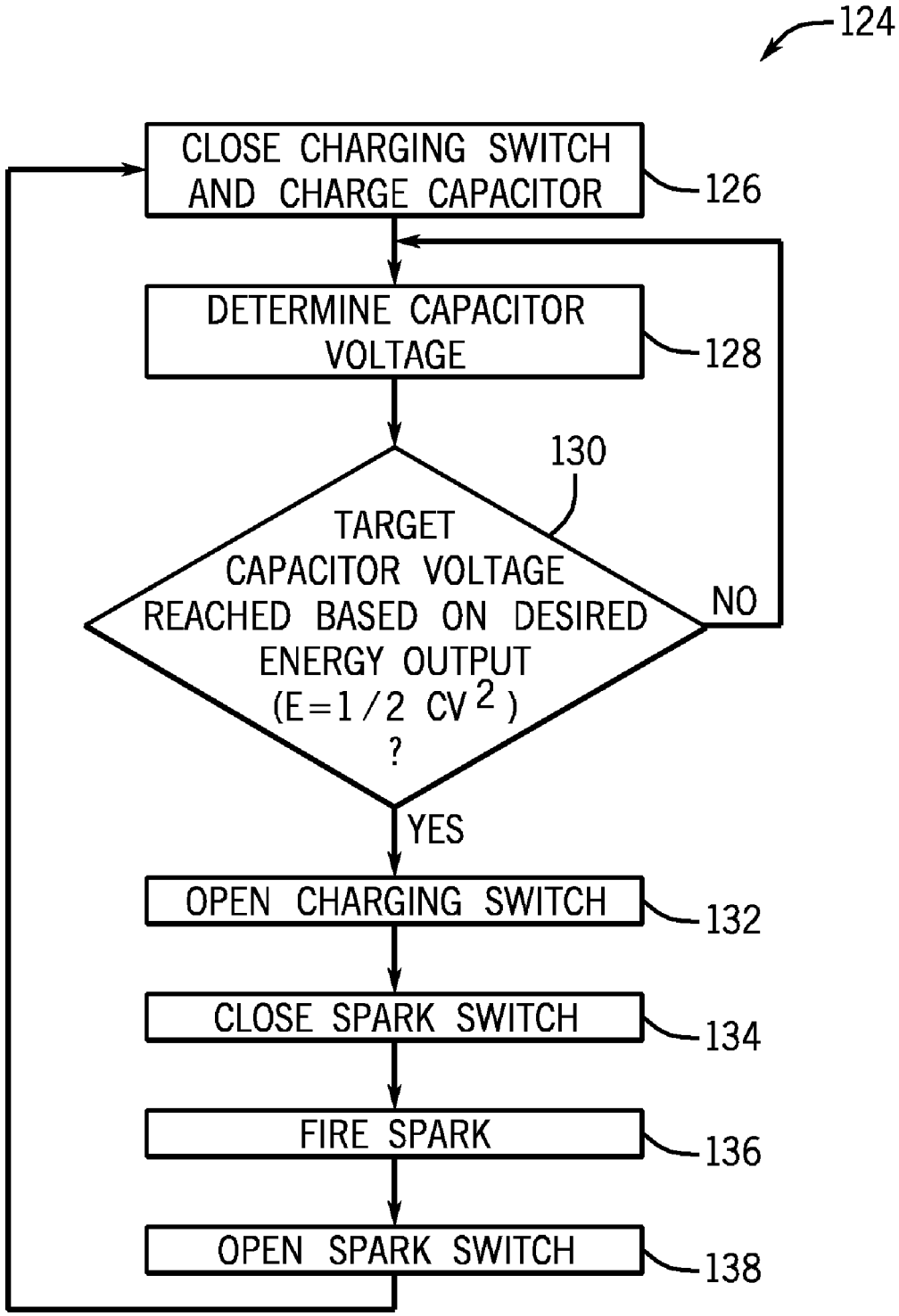
FIG. 5 is a flow chart illustrating a method for operating the ignition control system shown in FIG. 3, in accordance with another embodiment.

Referring now to FIG. 5, a method 124 depicts a technique, referred to a charge control algorithm, for operating the spark control circuitry 42. In comparison to the discharge control algorithm depicted in FIG. 4, the method 124 may instead control the charging of the capacitor 63 until the target voltage ($V_C$) is obtained. That is, rather than fully charging and controlling the discharge rate of the capacitor 63 to obtain the target voltage ($V_C$), the method 124 monitors the charging of the capacitor 63 to obtain the target voltage ($V_C$), and stops charging the capacitor 63 once the target voltage ($V_C$) is obtained. Further, in an embodiment of the spark control circuitry 42 that utilizes the charge control method 124, certain components depicted in FIG. 3 may not be present. For instance, the capacitor 63 will be discharged to the spark circuit 90 once the target voltage ($V_C$) is reached during the charging phase, and thus the discharge switch 66 and control signal line 84 may not be needed. In some embodiments, the resistor 68 may also be removed or placed in series between the AC to DC converter 62 and the capacitor 63.

Beginning at step 126, the capacitor 63 may initially be discharged, and the switches 64 and 70 may initially be open. At step 126, the charging switch 64 is closed and the capacitor 63 may be charged using the power provided by the power line 60. During the charging phase, the microcontroller 40 may continuously or intermittently monitor the voltage across the capacitor 63, as depicted at step 128, to determine at step 130 whether the voltage across the capacitor 63 matches the target voltage ($V_C$). As discussed above, this calculation may be made based upon Equation 1. If, at step 130, the capacitor 63 has not yet been charged to a level that corresponds to the target voltage ($V_C$), then the method 124 returns to the step 128, wherein the charge switch 64 remains closed and the capacitor 63 continues to be charged under the control of the microcontroller 40.

If, at step 130, it is determined that the voltage across the capacitor 63 matches the target voltage ($V_C$), the charge switch 64 is opened at step 132. Next, the ignition switch 70 is closed at step 134. This causes the charge stored in the capacitor 63 to be discharged to the spark circuit 90, which causes an electrical spark having the desired energy level (E) to be produced at the spark plug 44 at step 136. Thereafter, the ignition switch 70 is opened at step 138. As shown in FIG. 5, the step 138 may return to step 126, whereby the method 124 repeats thereafter.

Thus, the disclosed embodiments for controlling the frequency and/or energy level of ignition events (e.g., electrical sparks across spark plug 44) for producing combustion may include controlling the discharging of the capacitor 63 (e.g., method 100 of FIG. 4), as well as controlling the charging of the capacitor 63 (e.g., method 124 of FIG. 5).

As discussed above, one combustion-based application which may be particularly well-suited to the present technique may be an impulse cleaning system, such as depicted by reference number 32 in FIG. 1. Generally, such a system 32 may direct shock waves produced by the combustion process towards a surface that is to be cleaned. For instance, the surface may be the wall of a vessel within a boiler system that is contaminated with soot, debris, or other buildup resulting from its own combustion processes (e.g., combustion within a combustion chamber of the boiler system). As discussed above, the contaminated surface may lower system efficiency by reducing the amount of heat that is transferred to a liquid. Thus, energy provided by the combustion shock waves produced by the impulse cleaning system 32 may be directed at the contaminated surface to loosen debris, deposits, and coatings that have accumulated.

Figure 6:
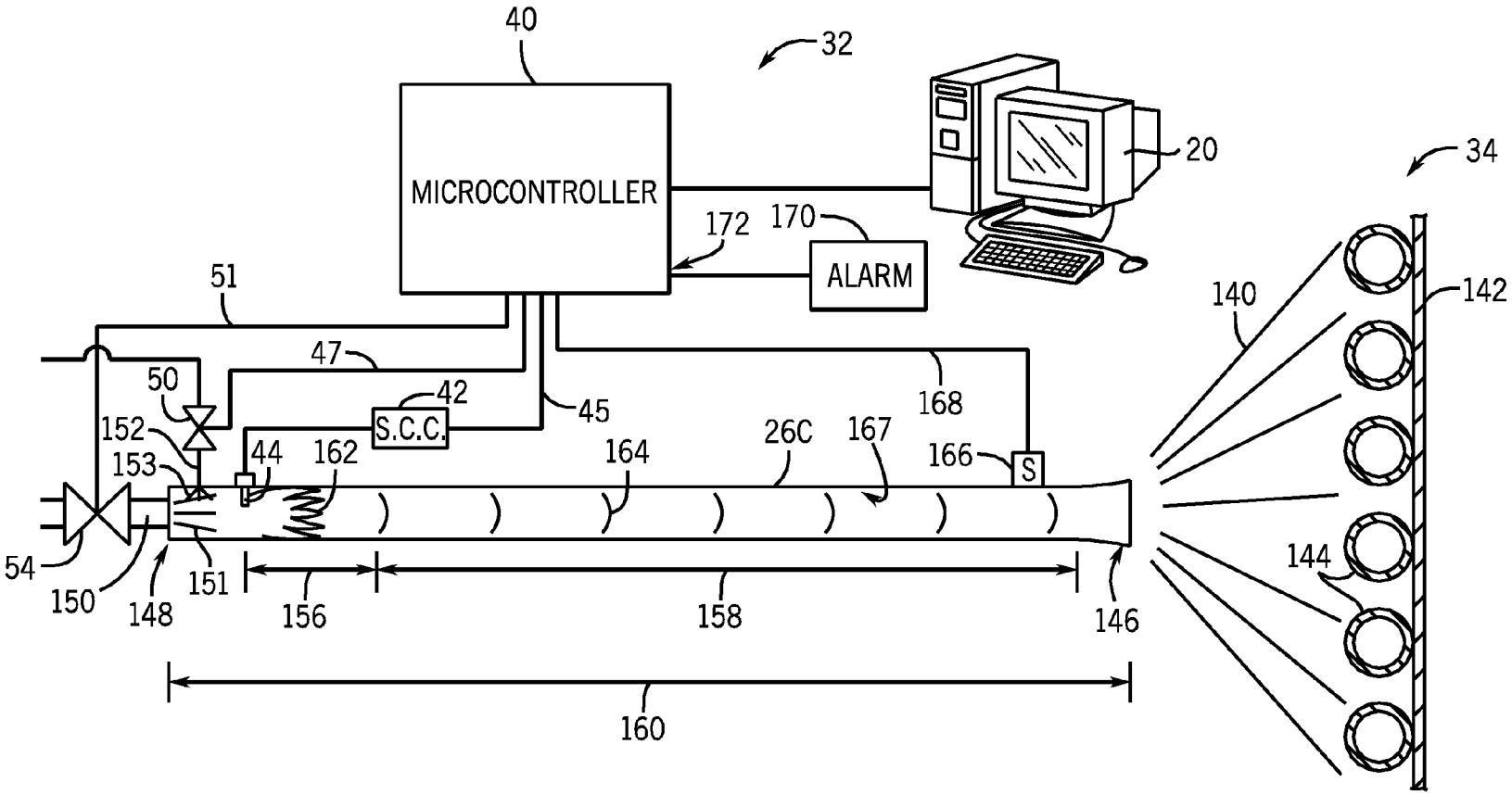
FIG. 6 is a diagram illustrating an embodiment of an impulse cleaning system that may utilize an ignition control system, as shown in FIG. 2, for controlling combustion.

FIG. 6 illustrates an exemplary embodiment of an impulse cleaning system 32 that may be utilized to clean a contaminated wall 142 of equipment 34. For instance, the equipment 34 may be a boiler vessel that includes heat exchanger tubes 144. The impulse cleaning system 32, using combustion, may generated a series of detonations or quasi-detonations that are directed towards the wall 142 and the tubes 144, which may be contaminated with soot, debris, or some other type of undesirable buildup. The resulting impulse waves impact the boiler surfaces and loosen buildup from these surfaces. The loosened debris is free to fall to the bottom of the boiler and then may exit the boiler through hoppers.

As used herein, the term "impulse cleaning system" will refer to a device or system that produces both a pressure rise and velocity increase from the detonation or quasi-detonation of a fuel and oxidizer. The impulse cleaning system 32 can be operated in a repeating mode (e.g., successive ignition events at a high repetition rate) to produce multiple detonations or quasi-detonations within the device. These detonations or quasi-detonations form a pulse of energy in the form of a shock wave that can be used for cleaning built-up deposits and accumulated debris from surfaces of the boiler vessel 34, or some other contaminated surface. By way of example only, the impulse cleaning system 32 may be a model of a Powerwave+® system, available from General Electric Company of Schenectady, N.Y.

As used herein, a "detonation" shall be understood to mean a supersonic combustion event in which a shock wave is coupled to a combustion zone. The shock wave is sustained by the energy released from the combustion zone, resulting in combustion products at a higher pressure than the combustion reactants (e.g., fuel and air). For simplicity, the term "detonation" as used herein will be meant to include both detonations and quasi-detonations. A "quasi-detonation" is a supersonic turbulent combustion process that produces a pressure rise and velocity increase higher than a pressure rise and velocity increase produced by a sub-sonic deflagration wave.

As shown in FIG. 6, the impulse cleaning system 32 includes a combustion chamber 26C, which includes a tubular body having a length 160 that extends longitudinally with an open "horn" end 146 directed at the wall 142 and tubes 144 of a boiler vessel. In one embodiment, the combustion chamber 26C may have a length 160 of between approximately 36 inches to 100 inches or more. In other embodiments, the length 160 may be between approximately 90 centimeters to 250 centimeters or more. The combustion chamber 26C includes an opposite closed head end 148 with at least one air inlet port 150 and fuel inlet port 152. The combustion chamber 26C has a deflagration zone 156 and a detonation zone 158. In the illustrated embodiment, the impulse cleaning system 32 is mounted or positioned using one or more brackets, hangers, and so forth, so that the impulse cleaning system 32 can be used to perform a cleaning operation of the wall 142 and tubes 144. For instance, the impulse cleaning system 32 may be mounted such that it can direct shock waves or cleaning pulses of energy 140 at the wall 142 and tubes 144 which, as discussed above, may be part of a boiler vessel.

As shown in FIG. 6, the impulse cleaning system 32 includes the spark control circuitry 42, the spark plug 44, and the microcontroller 40. These components may collectively form the ignition control system 28C of FIG. 1. A user or operator may interface with the microcontroller 40 by way of the local control/monitoring station 20, or via a remote control/monitoring station 12 (FIG. 1) to control various parameters of the combustion process, such as the target energy level, frequency, intensity, amplitude, and timing factors that relate to combustion dynamics. Additionally, the impulse cleaning system 32 may include a sensor 166 associated with the impulse cleaning system 32, as well as an alarm 170 for detecting and alerting an operator upon the occurrence of certain alarm conditions.

The head end 148 of the impulse cleaning system 32 may have its air inlet ports 150 connected to a source of air that can be provided under pressure through the air valve 54 to deliver a flow of air 151 to the combustion chamber 26C. This air source is used to fill and purge the combustion chamber 26C, and also provides air to serve as an oxidizer for the combustion of the fuel. The inlet ports 150 may be connected to a facility air source such as an air compressor. The fuel inlet port(s) 152 is located at the head end 148 of the impulse cleaning system 32 and, in the present embodiment, extends in a transverse direction relative to the air inlet ports 150. The fuel inlet port(s) 152 supplies a flow of fuel 153 to the combustion chamber 26C through the fuel valve 50. The fuel 153 that is supplied to the combustion chamber 26C is mixed with the flow of air 151 to create an air-fuel mixture that is suitable for combustion upon being ignited by an ignition event, such as an electrical spark generated by the spark plug 44.

The mixing of the fuel 153 and air 151 may be enhanced by the relative arrangement of air inlet ports 150 and the fuel inlet port(s) 152. For example, multiple fuel inlet ports 152 may be provided around the periphery of the combustion chamber 26C. By placing the fuel inlet port or ports 152 at locations such that fuel 153 is injected into regions of high turbulence generated by the flow of air 151, the fuel 153 and air 151 may be more rapidly mixed to provide a more readily detonable fuel/air mixture. As with the air inlet ports 150, the fuel inlet ports 152 may be disposed at a variety of axial and circumferential positions with respect to the combustion chamber 26C. The fuel inlet ports 152 may be aligned to extend in a purely radial direction, or may be arranged axially or circumferentially with respect to the radial direction. For instance, the fuel inlet ports 152 may be arranged along the axial direction (e.g., along the length 160) at same or different circumferential positions along the inner wall 167 of the combustion chamber 26C. Alternatively, the fuel inlet ports 152 may be arranged at the same axial position, but at different circumferential positions along the inner wall 167 of the combustion chamber 26C.

Fuel 153 is supplied to the fuel inlet ports 152 through the valve 50 that controls when fuel is allowed into the combustion chamber 26C. The valve 50 may be disposed within the fuel inlet port 152, or may be disposed upstream in a supply line that is connected to the fuel inlet port 152. In some embodiments, the valve 50 may be a solenoid valve and may be controlled electronically by the microcontroller 40 to open and close in order to regulate the flow of fuel 153 into the combustion chamber 26C. The microcontroller 40 may also electronically control the air valve 54 and the flow of air 151 to the combustion chamber 26C. As discussed above, the microcontroller 40 may include digital and/or analog communication paths 47 and 51 for controlling various aspects of the valves 50 and 54, respectively, including opened states, closed states, partially open/closed states, valve timing, and so forth.

In the illustrated embodiment, the ignition device 44 (e.g., spark plug) is located near the head end 148 of the combustion chamber 26C. The spark plug 44 ignites the fuel/air mixture (e.g., mixture of 151 and 152) to create combustion 162 in the deflagration zone 156. While illustrated herein as being a spark plug that produces an electrical spark, it should be appreciated that the ignition device 44 may take various forms, such as a plasma igniter, laser pulse device, or some other suitable device for producing an ignition event. In other embodiments, the spark may also be produced near the horn end 146 to achieve a similar result.

As discussed above, the spark plug 44, under control of the microcontroller 40 and the spark control circuitry 42 (e.g., using either method 100 of FIG. 4 or method 124 of FIG. 5), accurately produces ignition events having a certain desired energy level. The energy released into the spark plug 44 cause an electrical spark that produces combustion having the appropriate characteristics for a given combustion-based application (e.g., an impulse cleaning application). For instance, the spark plug 44 may provide a target energy output (E) for ignition that allows the combustion of the fuel/air mixture within the combustion chamber 26C to transition to a supersonic shock wave 164 within the detonation zone 158 of the combustion chamber 26C. Further, as discussed above, the microcontroller 40 may operate the ignition device 44 at desired or periodic times.

Upon the occurrence of an ignition event, such as an electrical spark from the spark plug 44, combustion of the fuel/air mixture, represented by reference number 162, takes place within the combustion chamber 26C. In general, combustion 162 will progress from the ignition device 44 through the mixture that is within the combustion chamber 26C. While FIG. 6 illustrates a cross-section of the combustion chamber 26C in the shape of a substantially round hollow cylinder having a constant cross-sectional area, other configurations of the combustion chamber 26C are also within the scope of the present disclosure. For instance, in one embodiment, the inner surface 167 of combustion chamber 26C may include one or more obstacles disposed at various axial locations along the length 160. Such obstacles may enhance combustion 162 as it progresses along the length 160, and may accelerate the combustion 162 into a supersonic shock wave 164 before the combustion 162 reaches the horn end 146 at the downstream end (e.g., relative to the direction of the shock waves 164) of the combustion chamber 26C. The combustion chamber 26C and obstacles therein may be fabricated using a variety of materials suitable for withstanding the temperatures and pressures associated with the repeated detonations. By way of example only, such materials include may include, stainless steel, aluminum, carbon steel, or a nickel-chromium alloy, such as Iconel®, available from Special Metals Corporation of New Hartford, N.Y. (a subsidiary of Precision Castparts Corporation of Portland, Oreg.).

The horn end 146 may be formed as a diverging chamber that extends from the combustion chamber 26C of the impulse cleaning system 32. It will be apparent that although the diverging chamber need not be in direct contact with the impulse cleaning system 32, it is desirable that the combustion chamber 26C of the impulse cleaning system 32 is in fluid flow communication with the diverging chamber of the horn end 146.

The supersonic shock waves 164 produced within the combustion chamber 26C form cleaning energy 140 to loosen accumulated debris, deposits and coatings that can accumulate on the walls 142 and tubes 144 of a boiler vessel or other device or equipment. High pressure fluid flow that follows the detonation helps to blow the loosened material away from the cleaned surfaces. In operation, the impulse cleaning system 32 creates a supersonic shock wave 164 and its associated high-pressure flow from a combustion cycle, which is repeated at low frequency (e.g., between 1 to 100 Hz), as controlled by the microcontroller 40 and spark control circuitry 42. Each combustion cycle generally includes a fill phase, an ignition event, a flame acceleration into detonation or a supersonic phase, and a blowdown phase. That is, a single occurrence of a fuel fill phase, a combustion ignition, an acceleration of the flame front to supersonic, and the blow down and purge of the combustion products will be referred to as "a combustion cycle" or "a detonation cycle".

The operation of the impulse cleaning system 32 during each step of a combustion cycle or detonation cycle is discussed below. The portion of time that the impulse cleaning system 32 is active is referred to as "cleaning operation." Time when the vessel to be cleaned is being actively used for its purpose will be referred to as "boiler operation." As noted above, the parts or surface to be cleaned need not be part of a boiler vessel. However, for simplicity, the term "boiler operation" will be used to refer to the operation of any device being cleaned by the impulse cleaning system 32.

Further, it should be understood that there is no need to shut down the boiler vessel or other parts being cleaned in order to operate the cleaning system. Specifically, it is possible for the cleaning operation to take place during the boiler operation. The impulse cleaning system 32 need not be run continuously during the boiler operation. However, by providing the flexibility to operate the cleaning system on a regular cycle during or between boiler operation, an overall higher level of cleanliness can be maintained without significant downtime in boiler operation.

In the fill phase of the combustion cycle, air 151 and fuel 153 are fed into the combustion chamber 26C of the impulse cleaning system 32 via the air inlet ports 150 and the fuel inlet ports 152. The fuel 153 and air flow 151 will mix to form a fuel/air mixture suitable for combustion within the combustion chamber 26C. As fuel and air are introduced and mixed, the combustion chamber 26C will tend to fill with the fuel/air mixture, starting near the closed head end 148 and proceeding along the length 160 of the combustion chamber 26C as more fuel and air are introduced. Air flow 151 can be continuously fed to the impulse cleaning system 32 through the air inlet ports 150 during cleaning operations.

As discussed above, the microcontroller 40 may be configured to control the timing of the fuel valve 50 (via analog or digital signal 47) and the air valve 54 (via analog or digital signal 51) relative to one another. In one embodiment, the microcontroller 40 may be configured to monitor the amount of time that has elapsed since the opening of the fuel valve 50. Based upon the rate of air input to the impulse cleaning system 32, the microcontroller 40 can close the fuel valve 50 once a sufficient amount of fuel 153 has been introduced and added, such that the fuel/air mixture has the desired proportions within the combustion chamber 26C. The microcontroller 40 may then initiate operation of the spark control circuitry 42 using the techniques described above to provide ignition energy to the ignition device 44. In general, the ignition device 44, such as a spark plug, delivers a target energy output (E) into the mixture near the ignition device 44 to form an expanding combustion front 162 in the fuel/air mixture. As discussed above, the target energy output (E) may be obtained by releasing the appropriate amount energy from an energy storage device (e.g., capacitor 63) by monitoring the voltage across the capacitor 63 while it is being charged and/or discharged. As the combustion front 162 consumes the fuel by burning it with the oxidizer (e.g., air) present in the mixture, a combustion flame will propagate through the mixture within the combustion chamber 26C.

As the combustion front 162 propagates through the combustion chamber 26C, the combustion front 162 will reach the inner wall 167 of the combustion chamber 26C and any obstacles that are disposed thereon. The interaction of the combustion front 162 with the inner wall 167 and the obstacles may tend to generate an increase in pressure and temperature within the combustion chamber 26C. Such increased pressure and temperature tend to increase the speed at which the combustion front 162 propagates through the combustion chamber 26C and the rate at which energy is released from the fuel/air mixture by the combustion front 162. This acceleration continues until the combustion speed raises above that expected from an ordinary deflagration process in the deflagration zone 156 to a speed that characterizes a quasi-detonation or detonation in the detonation zone 158. This deflagration-to-detonation process may take place rapidly (in order to sustain a high cyclic rate of operation), and thus the obstacles within the combustion chamber 26C may be used to decrease the run-up time and distance that is required for each initiated flame to transition into a detonation.

The detonation or supersonic shock wave 164 travels down the length 160 of the combustion chamber 26C and out of the horn end 146 as pulses of cleaning energy 140. From the horn end 146, the cleaning energy 140 may be directed at the object to be cleaned, such as the wall 142 and tubes 144. High pressure combustion products, such as combustion gases, may follow the supersonic shock wave 164 and flow through the horn end 146. The high pressure combustion products may be utilized for blowing or removing debris or other buildup that is loosened by the cleaning energy pulses 140.

As the high-pressure products blow out of the impulse cleaning device 32, the continued supply of air flow 151 through the air inlet ports 150 will tend to push the combustion products downstream and out of the horn end 146. Such continued supply of air flow 151 is used to purge the combustion products from the combustion chamber 26C of the impulse cleaning device 32. Once the combustion products are purged, the valve 50 for the fuel port 152 may be opened, and a new fill phase may be initiated to begin the next combustion cycle.

As discussed above, the microcontroller 40 may produce multiple ignition events, and thus multiple supersonic shock waves 164 in rapid succession. For instance, in one embodiment, the microcontroller may produce a burst of ignition events (e.g., electrical sparks) that vary in energy content. By way of example, the burst may alternate between a first electrical spark having an energy level of approximately 1 J and a subsequent second electrical spark having an energy level of between approximately 0.6 to 0.8 J (e.g., a first 1 J spark, a second 0.8 J spark, a third 1 J spark, a fourth 0.8 J spark, and so forth). The variations in the energy level of successive sparks may also be expressed as percentages relative to one another. For instance, in one embodiment, alternating electrical sparks may include a first spark having a first energy level and a second spark that has a second energy level that less than the first energy level by between approximately 10 to 50 percent. In another example, the burst may alternate between a first electrical spark having an energy level of approximately 1 J and a subsequent second electrical spark having a relatively lower energy level, such as less than 0.1 J, that functions as a clean-up spark. Further, in one embodiment, the impulse cleaning system 32 may include multiple ignition devices 44, each controlled by a respective ignition control system 28. In such embodiments, bursts of ignition events may be produced by timing the ignition of each of the ignition devices in an anti-coincident manner.

The supersonic shock wave 164 that exits from the horn end 146 includes an abrupt pressure increase (as cleaning energy 140) that will impact the wall 142 and tubes 144 of the boiler vessel. This cleaning energy 140 has several beneficial effects by breaking up accumulated debris and slag from the wall 142 and tubes 144 of the boiler vessel. For instance, the cleaning energy 140 can produce pressure waves that travel through the accumulated slag and debris. Such pressure waves can produce flexing and compression within the accumulations that can enhance crack formation within the debris and break portions of the debris away from the rest of the accumulation, or from the wall 142 and tubes 144 of the boiler vessel. This may appear as "dust" that is liberated from the surface of the accumulated debris.

In addition, the pressure change associated with the passage of the cleaning energy 140 can produce flex in the walls 142 of the boiler itself, which can also assist in separating the debris and slag from the wall 142 and tubes 144 of the boiler vessel. The repeated impacts from the cleaning energy 140, as the product of repeating combustion cycles, may excite resonances within the debris that can further enhance the internal stresses experienced and promote the mechanical breakdown of the debris. In this manner, the repeated action of shock and purge is used to remove build-up that accumulates upon the wall 142 and tubes 144 of the boiler vessel.

Because the impulse cleaning system 32 may be located in an area that is either visually or audibly inaccessible by an operator or attendant during operation, it may be difficult to verify visually or audibly that the impulse cleaning system 32 is operating properly. In the present embodiment, the impulse cleaning system 32 includes a sensor 166 that provides operation feedback 168 to the microcontroller 40. The operational feedback 168 may be utilized to provide the operational state of the impulse cleaning system 32 via the local control/monitoring station 20 or the remote control/monitoring station 12 (FIG. 1), so that an operator at either of these stations may assess the operational state of the impulse cleaning system 32. Further, using the operation feedback 168, the system 32 may be able to adjust and/or modify combustion parameters (e.g., energy, frequency, timing, pressures, etc.) during operation via user initiated inputs (e.g., through the local control/monitoring station 20 or the remote control/monitoring station 12). For instance, the system 32 may be configured to adjust such parameters on the fly or in substantially real-time in response to feedback data 168 and/or user inputs.

For instance, the sensor 166 may be an accelerometer, a strain gauge, an acoustic detection device, a pressure gage and an ion probe, or the like, that is configured to detect if a detonation or supersonic shock wave 164 occurred and to provide information that can be monitored to determine whether there is any decline in performance or loss of energy during operation of the impulse cleaning system 32. This information can be used to perform diagnostics on the impulse cleaning device 32, to provide feedback for an emergency cutoff circuit, to sound an alarm 170 when an alarm condition is detected, and/or to verify operation of the impulse cleaning device 32 when it is located remotely relative to an operator/attendant or otherwise not readily accessible to a person. Further, by mounting the sensor 166 externally of the combustion chamber 26C, the hot and acidic gases from the combustion process do not contact the sensor 166 and cause early degradation of the sensor and prolong its life.

The signal 168 generated by the sensor 166 may include a signal that is a function of the supersonic shock wave 164 in the impulse cleaning system 132, such as intensity. The controller 40 may use this information to control the delivery of fuel 153 and/or pressurized air flow 151 to the combustion chamber 26C and/or the delivery of ignition energy to the ignition device 44. Thus, the controller 40 receives the signal 168 generated by the sensor 166 to control production of the supersonic shock wave 164 in response to the signal. This allows automatic feedback to the controller 40 as to whether impulse cleaning system 32 is operating correctly, or not at all, or if there is any degradation/improvement in performance. The sensor 166 and controller 40 thus provides accurate and quick response feedback to an operator/attendant, either at the local control/monitoring station 20 or a remote control/monitoring station 12 (FIG. 1) as to the status of the impulse cleaning system 32 and whether it is operating properly without requiring periodic visual inspection of the impulse cleaning system 32.

As discussed above, the sensor 166 may include an accelerometer that can be selected and calibrated to provide a data signal 168 to the controller 40 to indicate that a detonation event has taken place and also to indicate the intensity of the supersonic shock wave 164. In one embodiment, the controller 40 can be programmed to generate an alarm signal that activates an audible or visual signal on alarm 170 in response to a predetermined period of time elapsing before a supersonic shock wave 164 in the combustion chamber 26C is detected by the accelerometer sensor 166. The lack of a combustion event when expected can also trigger this alarm 170. In certain embodiments, the microcontroller 40 may control the alarm 170 via a digital I/O port 172. The alarm signal can also be used to signal or provide an alarm notification on the local control/monitoring station 20 or a remote control/monitoring station 12 (FIG. 1).

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

The invention claimed is:

1. A system, comprising:

a combustion-based system comprising a combustion chamber; and an ignition control system comprising:

an ignition device coupled to the combustion chamber;

control circuitry comprising an energy storage device configured to supply energy to the ignition device to produce an ignition event having a desired energy level; and a controller configured to obtain a target voltage across the energy storage device and to discharge an ignition energy from the energy storage device after obtaining the target voltage;

wherein the ignition control system is configured to supply the ignition energy to the ignition device to produce the ignition event.

2. The system of claim 1, wherein the controller is configured to obtain the target voltage across the energy storage device by:

fully charging the energy storage device; and discharging a first portion of energy stored in the energy storage device to a resistive device until a voltage across the energy storage device corresponds to the target voltage.

3. The system of claim 2, wherein the control circuitry comprises:

an input configured to receive a power signal from a power source;

a first switch operable to a first closed position and a first open position, wherein the first switch is arranged in series between the input and the energy storage device, and the energy storage device is charged by the power source when the first switch is in the first closed position;

a second switch operable to a second closed position and a second open position, wherein the second switch is arranged in series between the energy storage device and the resistive device, and the energy storage device discharges the first portion of energy into the resistive device when the second switch is in the second closed position; and a third switch operable to a third closed position and a third open position, wherein the third switch is arranged in series between the energy storage device and the ignition device, and the energy storage device is configured to discharge the ignition energy to the ignition device when the third switch is in the third closed position.

4. The system of claim 3, wherein the controller comprises:

a first output configured to provide a first control signal for switching the first switch between the first closed position and the first open position;

a second output configured to provide a second control signal for switching the second switch between the second closed position the second open position; and a third output configured to provide a third control signal for switching the third switch between the third closed position the third open position.

5. The system of claim 1, wherein the energy storage device comprises one or more capacitors.

6. The system of claim 1, wherein the controller comprises a microcontroller, a programmable logic controller, an application specific integrated circuit, or any combination thereof.

7. The system of claim 1, comprising a local control and monitoring station configured to communicate with the controller, wherein the local control and monitoring station comprises an interface enabling a user to adjust one or more parameters relating to the ignition event.

8. The system of claim 7, wherein the local control and monitoring station is networked to a remote control and monitoring station at a location remote from the local control and monitoring station, and wherein the remote control and monitoring station enables a user to adjust the one or more parameters relating to the ignition event from the remote location.

9. The system of claim 8, wherein the one or more parameters relating to the ignition event are adjustable by the system in response at least one of operational feedback data or user initiated inputs received by the local control and monitoring station or the remote control and monitoring station.

10. The system of claim 1, wherein the controller is configured to obtain the target voltage across the energy storage device by supplying charge to the energy storage device until a voltage across the energy storage device corresponds to the target voltage.

11. The system of claim 1, wherein the ignition event comprises an electrical spark, and the ignition device comprises a spark plug configured to produce the electrical spark.

12. A tangible machine-readable storage media having encoded instructions executable by a processor, the encoded instructions comprising:

code configured to initiate charging of a capacitor of an ignition control circuit, wherein the ignition control circuit is configured to supply energy to an ignition device to produce a first ignition event having a desired energy level for igniting a mixture of fuel and oxidizer within a combustion chamber of a combustion-based system;

code configured to identify a full charge state of the capacitor;

code configured to, after identification of the full charge state of the capacitor, discharge a first portion of energy stored in the capacitor to a resistive device until a voltage across the capacitor corresponds to a target voltage; and code configured to, when the voltage across the capacitor corresponds to the target voltage, discharge a remaining portion of energy from the capacitor to the ignition device to produce the first ignition event.

13. The tangible machine-readable storage media of claim 12, comprising code configured to predict an energy level of the ignition event produced by the ignition device by measuring the voltage across the capacitor while the first portion of energy is being discharged.

14. The tangible machine-readable storage media of claim 13, wherein the code configured to discharge the remaining portion of energy from the capacitor to the ignition device is executed when the measured voltage corresponds to the target voltage, and the energy level of the first ignition event corresponds to the desired energy level.

15. The tangible machine-readable storage media of claim 12, comprising code configured to adjust at least one of a first valve for controlling a flow rate of the fuel and a second valve for controlling a flow rate of the oxidizer.

16. The tangible machine-readable storage media of claim 12, comprising code configured to produce one or more additional ignition events subsequent to the first ignition event, wherein each of the one or more additional ignition events are produced in accordance with a respective desired energy level.

17. The tangible machine-readable storage media of claim 16, wherein the first ignition event and the subsequent additional ignition events occur at a frequency of between approximately 1 hertz and approximately 60 hertz.

18. An impulse cleaning system, comprising:

a combustion chamber configured to receive a mixture of fuel and air, the mixture of fuel and air being ignitable to produce combustion that results in a shock wave; and an ignition control system configured to produce an electrical spark having a desired energy level for igniting the mixture of air and fuel, wherein the ignition control system comprises:

a spark plug configured to produce an electrical spark within the combustion chamber for igniting the mixture of fuel and air;

control circuitry comprising a capacitor configured to supply energy to the spark plug to produce the electrical spark; and a controller configured to charge the capacitor to a full charge state, to discharge a first portion of energy from the full charge state of the capacitor to a resistive device until a voltage measured across the capacitor corresponds to a target voltage, and, when the voltage measured across the capacitor corresponds to the target voltage, to discharge a remaining portion of energy from the capacitor to the spark plug to produce the electrical spark having the desired energy level to ignite the mixture of fuel and air and to produce the shock wave.

19. The impulse cleaning system of claim 18, wherein the combustion chamber comprises an open diverging end configured to direct the shock wave at a surface to be cleaned.

20. The impulse cleaning system of claim 18, wherein the desired energy level of the electrical spark is between approximately 0.5 to 1 joules.

* * * * *